United States Patent [19]

Yasuda

[11] Patent Number: 4,571,065

[45] Date of Patent: Feb. 18, 1986

[54] SCALE FACTOR CHANGING MECHANISM FOR COPYING MACHINE

[75] Inventor: Keiryo Yasuda, Kanagawa, Japan

[73] Assignee: Fuji Xerox Co., Ltd., Tokyo, Japan

[21] Appl. No.: 556,820

[22] Filed: Dec. 1, 1983

[30] Foreign Application Priority Data

Dec. 1, 1982 [JP] Japan ..... 57-209227

[51] Int. Cl.[4] ..... G03G 15/00

[52] U.S. Cl. ..... 355/11; 355/8; 355/55; 355/57

[58] Field of Search ..... 355/8, 55, 56, 3 R, 355/57, 60, 65, 66, 51, 16, 11

[56] References Cited

U.S. PATENT DOCUMENTS 4,029,409 6/1977 Spinelli et al. ..... 355/51
4,093,374 6/1978 Zucker et al. ..... 355/8 X
4,095,880 6/1978 Shogren et al. ..... 355/8
4,351,605 9/1982 Carpenter et al. ..... 355/8
4,362,382 12/1982 Simpson ..... 355/8 X
4,372,670 2/1983 Carpenter et al. ..... 355/8

*Primary Examiner*—A. C. Prescott
*Attorney, Agent, or Firm*—Sughrue, Mion, Zinn, Macpeak & Seas

[57] ABSTRACT

A copying machine with an optical system in which three mirrors are arranged between the surface of an original and a lens and one mirror is arranged between the lens and a photosensitive member. A scale factor changing mechanism utilizes one movable mirror arranged between the lens and photosensitive member and in parallel with the direction of the optical axis of the lens. An endless-belt-shaped member is employed as the photosensitive member. The endless-belt-shaped member has a flat exposure projection surface.

5 Claims, 4 Drawing Figures

SCALE FACTOR CHANGING MECHANISM FOR COPYING MACHINE

BACKGROUND OF THE INVENTION

This invention relates to a scale factor changing mechanism in a copying machine.

In order to change a scale factor in a copying machine, it is necessary to change the distance between the original's surface and a lens and the distance between the lens and a photosensitive surface. However, since the positions of the original and the photosensitive member are fixed because of the structure of the copying machine, the length of the optical path must therefore be corrected by displacing the lens and simultaneously by changing the positions of mirrors.

An electrographic copying machine as shown in FIG. 1 is well known in the art in which four mirrors are used in order to make the optical system compact. In this copying machine, the image of an original S on a platen of glass P is formed on the surface of a photosensitive drum D by means of a first mirror $M_1$, a second mirror $M_2$, a lens L, a third mirror $M_3$ and a fourth mirror $M_4$. In the case where two mirrors are interposed between the surface of the original and the lens and two mirrors are set between the lens and the photosensitive surface as described above, displacement of the mirrors for varying a scale factor is not simple parallel movement. Accordingly, the mirror position adjusting mechanism is necessarily intricate. Furthermore, in the above-described arrangement, the distance between the platen P and the photosensitive drum D is relatively large. This makes it difficult to sufficiently miniaturize the copying machine. Thus, attempts have been made to define systems where the mirrors are movable.

In a known mirror movement type electrographic copying machine in which four mirrors are arranged as shown in FIG. 2, first, second and third mirrors $M_1$, $M_2$ and $M_3$ are disposed between an original S and a lens L. A fourth mirror $M_4$ is set between the lens L and a photosensitive drum D. In this copying machine, the distance between the platen P and the photosensitive drum D is relatively small, which makes it possible to miniaturize the copying machine. The original is scanned by moving the first mirror $M_1$ in parallel with the surface of the original and moving the second and third mirrors $M_2$ and $M_3$ (which are supported by the same frame, not shown) in the same direction at a speed which is a half of the speed of the first mirror $M_1$. A scale factor can be changed by moving the lens L and the second and third mirrors $M_2$ and $M_3$ in parallel with the direction of the arrow A (or the direction of the optical axis of the lens). Accordingly, the mirror position adjusting mechanism for the copying machine in FIG. 2 is simpler than that for the copying machine in FIG. 1. However, the mechanism suffers from drawbacks. For example, since the mirrors M2 and M3 are held on the same frame and are heavy, the device has significant inertia. Shocks are caused when the mirrors are started or stopped for position adjustment and large power is required for position adjustment.

In order to overcome these disadvantages, a method in which instead of moving the second and third mirrors $M_2$ and $M_3$, the fourth mirror $M_4$ is moved, may be considered. In the case where the method is employed, it is necessary that, as shown in FIG. 3, while the fourth mirror $M_4$ is being moved in the direction of the arror A, its angle of inclination ($\alpha$) with the optical axis of the lens must be changed in order that a projection point on the photosensitive drum D is maintained unchanged. Accordingly, the mirror position adjusting mechanism is intricate. Furthermore, when a scale factor is changed, the exposure incident angle with respect to the surface of the photosensitive drum D is changed, and therefore the quality of picture may be lowered depending on a selected scale factor.

SUMMARY OF THE INVENTION

This invention has been developed given the above-described technical background.

An object of this invention is to define a scale factor changing mechanism that overcomes the disadvantages of the prior art.

Yet another object of this invention is to provide a scale factor changing mechanism that achieves a high degree of copying resolution yet is compact.

These and other objects of this invention are attained in a copying machine with an optical system in which one of four mirrors is arranged between a lens and a photosensitive member, according to the invention, the one lens is made movable in parallel with the direction of the optical axis of the lens. An endless-belt-shaped member is employed as the photosensitive member, the endless-belt-shaped member being so arranged that its exposure projection surface is flat.

This invention will be described in greater detail by referring to the accompanying drawing and the description of the preferred embodiment that follows.

DESCRIPTION OF THE PREFERRED EMBODIMENT

One embodiment of this invention will now be described with reference to FIG. 4.

Figure 1:
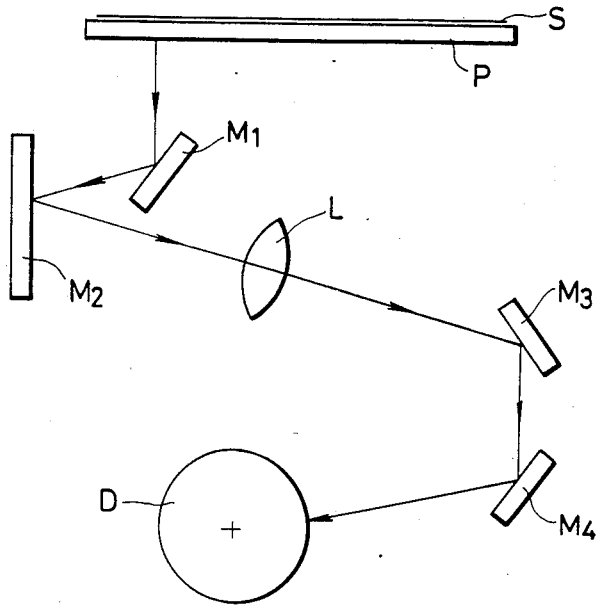
FIG. 1 PRIOR ART
FIGS. 1 and 2 are explanatory diagrams of copying machines having conventional optical systems.
Figure 2:
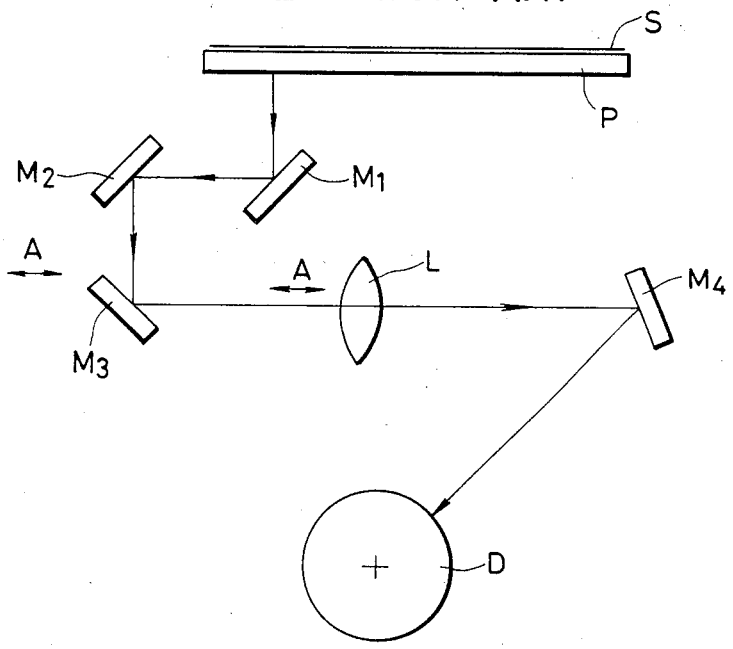
FIG. 2 PRIOR ART
Figure 3:
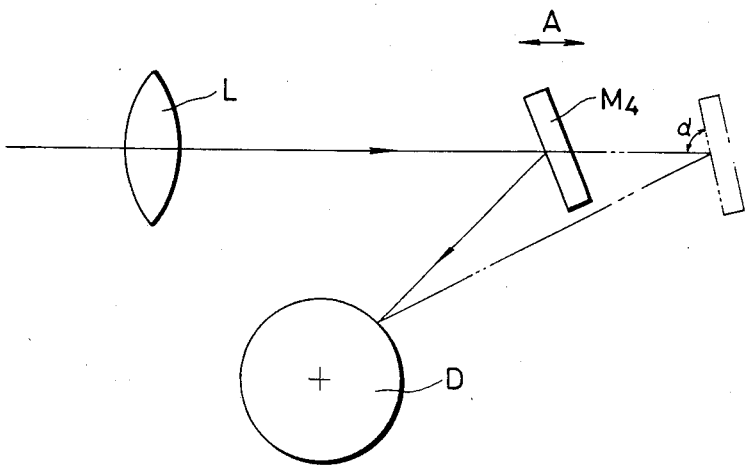
FIG. 3 PRIOR ART
FIG. 3 is an explanatory diagram showing a method of changing a scale factor in the copying machine in FIG. 2.
Figure 4:
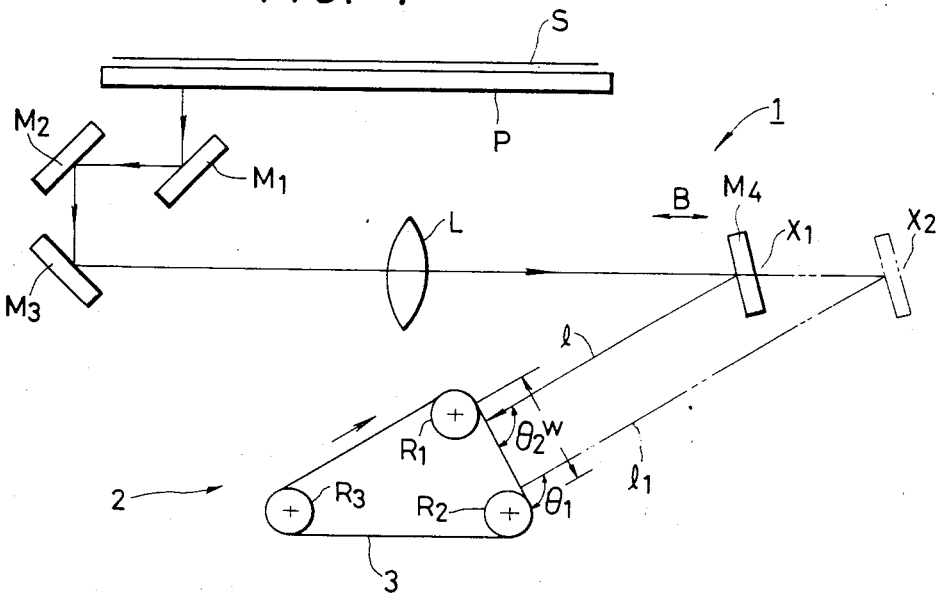
FIG. 4 is an explanatory diagram of a copying machine which employs an optical system according to the preferred embodiment of this invention.

In FIG. 4, reference numeral 1 designates a mirror movement type electrographic copying machine, the optical system of which is similar to that of the copying machine in FIG. 2 in that first, second and third mirrors $M_1$, $M_2$ and $M_3$ are disposed between an original S on a platen of glass P and a lens L. This mirror system is movable for scanning the original. A fourth mirror $M_4$ is arranged between the lens L and a photosensitive unit 2. A specific feature of the copying machine in FIG. 4 resides in that a scale factor is changed by moving the fourth mirror $M_4$ in parallel with the direction of the arrow B (or the direction of the optical axis of the lens) and that the photosensitive unit 2 is not cylindrical. That is, in the prior art a drum D is conventionally used.

The photosensitive unit 2 in accordance with this invention is made up of three rollers $R_1$, $R_2$ and $R_3$ and an endless-belt-shaped member 3 which is laid over these rollers and is turned by one of the rollers. The width w of the flat surface of the endless-belt-shaped member 3 which is defined by the rollers $R_1$ and $R_2$ (w being equivalent to the distance between the axes of the rollers $R_1$ and $R_2$) is selected so that it is equal, at least, to the width of the displacement of an incident light l which is required for changing a scale factor. The incident light l is applied to the endless-belt-shaped member 3 in the range of the width w.

Accordingly, when the fourth mirror $M_4$ is moved in parallel from the position $X_1$ to the position $X_2$ for changing the scale factor, the angle $\theta_1$, of the incident light l1 with respect to the photosensitive surface of the member 3 is equal to $\theta_2$ of the incident light l. Thus, the incident light l reflected from the fourth mirror $M_4$ forms a constant angle $\theta(\theta_1=\theta_2)$ with the photosensitive surface of the endless-belt-shaped member 3 at all times no matter what scale factor is selected. It is preferable that the angle $\theta$ is 90°.

Thus, in the scale factor changing mechanism according to the preferred embodiment of the invention, the endless-belt-shaped member 3 is used as the photosensitive element, whereby the fourth mirror $M_4$ is merely moved in parallel. This is in contrast to systems where the angle of the mirror is altered. The mirror $M_4$ is therefore smaller in size and weight than the assembly of the second and third mirrors $M_2$ and $M_3$ which are held on the same frame and are moved during scanning. Therefore, a reduced power is employed to move the fourth mirror and inertia loadings are reduced. When the fourth mirror is started or stopped shocks are minimized. Accordingly, the holding force of the holder of the fourth mirror may be small.

When a scale factor is changed, the angle $\theta$ of the incident light l with respect to the endless-belt-shaped member 3 is maintained unchanged. Therefore, the quality of picture is stable at all times.

The technical concept of the invention is applicable not only to a mirror movement type copying machine but also to an original movement type copying machine.

As is apparent from the above description, in the copying machine with the optical system in which one of the four mirrors is arranged between the lens and the photosensitive member, according to the invention the one mirror is made movable in parallel with the direction of the optical axis of the lens. An endless-belt-shaped member is employed as the photosensitive member and its exposure projection surface is arranged flat. Therefore, merely by moving the one mirror in parallel which is arranged between the lens and the photosensitive member, a scale factor can be changed and the angle of incident light with respect to the photosensitive member can be maintained unchanged at all times. Accordingly, the scale factor changing mechanism is simple, the copying machine can be miniaturized, yet the quality of picture can be stable at all times.

I claim:

1. A copying machine comprising:

a platen having a surface supporting an original to be copied;

a lens for focusing an image of said original on to a photosensitive member;

a series of mirrors for reflecting said image on to said lens, said mirrors at fixed positions in relation to said lens and to one another, one movable mirror arranged between said lens and said photosensitive member, said lens movable in parallel with the direction of the optical axis of said lens, and said photosensitive member comprising a flat belt employed as an exposure projection surface.

2. The copying machine of claim 1 wherein said flat belt comprises an endless movable belt disposed on a series of rollers, said exposure surface maintained in a constant angular relationship to said image reflected from said movable mirror irrespective of mirror displacement in a direction parallel to the optical axis of said lens.

3. The copying machine of claim 1 wherein said mirror is maintained in a constant angular relationship to the optical axis of said lens and wherein said belt has a width w and said movable mirror varies the scale factor by moving to project said image within the elective width of said belt.

4. The copying machine of claim 1 wherein said series of mirrors comprise three mirrors movable for scanning said original and directing the scanned image onto said lens.

5. The copying machine of claim 1 wherein said belt is a movable endless belt supported by three rollers, two of said rollers defining supporting said belt to define said exposure projection surface.

* * * * *